United States Patent [19]

Stanizzo

[11] 4,272,931

[45] Jun. 16, 1981

[54] PREFABRICATED SHELL ASSEMBLY FOR WINDOW TRIM

[76] Inventor: John A. Stanizzo, 430 Fernhill Ave., Pittsburgh, Pa. 15226

[21] Appl. No.: 40,764

[22] Filed: May 21, 1979

[51] Int. Cl.[3] ..... E06B 7/12

[52] U.S. Cl. ..... 52/98; 52/171; 52/211

[58] Field of Search ..... 52/171, 209, 211, 212, 52/98; 98/90

[56] References Cited

U.S. PATENT DOCUMENTS

| | | | |
|---|---|---|---|
| 967,955 | 8/1910 | Murname | 52/209 X |
| 1,150,790 | 8/1915 | Swanson | 52/211 |
| 2,617,701 | 11/1952 | Fennell | 52/171 X |
| 2,673,455 | 3/1954 | Brinkoeter | 52/171 X |
| 2,851,742 | 9/1958 | Johnston | 52/211 |
| 2,916,112 | 12/1959 | Kiehl | 52/211 X |
| 3,002,236 | 10/1961 | Hirmgehner | 52/211 X |
| 3,139,703 | 7/1964 | Hilt | 52/211 X |
| 3,449,873 | 6/1969 | Damato et al. | 52/211 X |
| 3,473,278 | 10/1969 | Gossen | 52/211 X |
| 3,975,875 | 8/1976 | Goss, Jr. | 52/211 |

FOREIGN PATENT DOCUMENTS

| | | | |
|---|---|---|---|
| 883523 | 7/1953 | Fed. Rep. of Germany | 52/171 |
| 1115002 | 10/1961 | Fed. Rep. of Germany | 52/211 |
| 2623781 | 12/1977 | Fed. Rep. of Germany | 52/211 |
| 251318 | 8/1948 | Switzerland | 98/90 |

*Primary Examiner*—Alfred C. Perham

[57] ABSTRACT

A trim assembly comprising an integral trim member having a generally L-shaped cross-section, in which one leg of the L is adapted for attachment to a wall to serve as the casement, while the other leg (flange section) projecting towards the window is adapted for attachment to the jamb surface of the window opening. The interior surface of the flange section is provided with closely-spaced, longitudinal grooves extending the length of the trim member. These grooves, preferably spaced at a distance of about ⅛ to ½ inch, are easily cut or broken off whereby the width can readily be modified to properly fit a wide variety of jamb-widths. The instant trim member, featuring a flange projecting towards the window, permits for the design of a hollow enclosure which can serve as a housing for a small blower to provide a source of flowing, preferably heated, air. The blower will preferably be incorporated within the sill-trim member, having ducts connected to similar ducts in the side-trim members and/or in the head-trim member, in turn communicating with inclined outlet apertures. Thus, air from the blower motor may be conducted through the ducts and exit the apertures so as to flow over the window surface, preferably as a sheet of air, thereby preventing condensation on the windows and the resulting moisture damage to surfaces in proximity therewith. In an alternate embodiment, the blower rather than being housed within a trim member, may be housed directly within the window frame, similarly to provide a source of moving air over the surface of the window.

5 Claims, 4 Drawing Figures

PREFABRICATED SHELL ASSEMBLY FOR WINDOW TRIM

Figure 1:
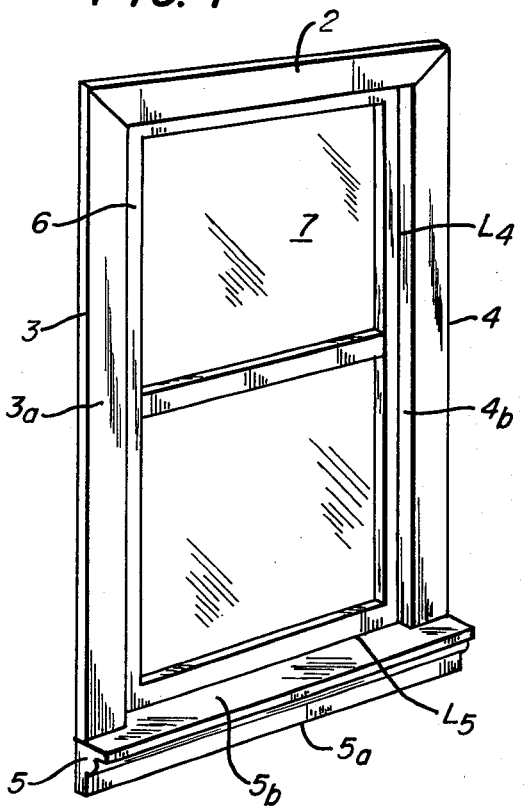

This invention relates to a prefabricated shell assembly for window openings. More particularly, it is directed to a prefabricated construction which may easily be employed, even by persons lacking construction skills, to trim windows at the site.

Conventional methods for the installation of window trim, as employed either for new construction or in the repair of damaged and unsightly trim, has a number of well known disadvantages. Primarily, such fabrication methods require the services of skilled tradesmen to perform the precise woodworking normally required. Prefabricated casings have been contemplated and some have actually been available to the construction industry. In one instance, for example, an entire rectangular frame has been assembled at the factory, resulting in a cumbersome structure which is both unwieldy to handle and susceptible to damage in shipping. Even when such frames reach the construction site undamaged, they further require very accurate fits at the factory; otherwise modification is required, thereby defeating the primary purpose of prefabrication. Additional examples of such prefabricated casing members, including numerous methods for attaching such members to the wall, may be found in U.S. Pat. Nos. 3,916,055, 3,667,177, 3,473,278, 3,449,873, 3,286,422, 3,103,710, 2,851,742, 2,653,687 and 2,198,287. Few of these have ever been used commercially and none have gained wide commercial acceptance—primarily, because they provided little advantage over the less expensive, conventional fabrication method. I have discovered, as a further factor for such lack of acceptance, that such prior art prefabricated casement members provide only a partial solution to the problems of the homeowner. Thus, the jamb surfaces (i.e. the inner surface of the window opening perpendicular to the wall and projecting towards the window) nevertheless remained a problem, particularly when such prefabricated casement members were supplied to cover-up existing, damaged trim or wall surfaces. Heretofore, when it was desired to cover-up or otherwise ornament this jamb surface; for example, by fabricating a stop member (double-hung windows) or in painting or otherwise repairing the jamb itself (casement sashes), it was necessary to resort to conventional fabrication techniques, not readily amenable to the "do-it-yourselfer". These problems are overcome in the instant invention by providing a trim member having a generally L-shaped cross-section in which one leg of the L serves conventionally as the casement section, while the other leg of the L, herein termed the border section, is adapted for attachment to the jamb surface of the window opening. Since such jamb surfaces will have widely varying widths (the normal distance from the plane of the wall to the window frame), the border section will be provided with longitudinal notches or grooves, permitting the border section width readily to be modified to such varying jamb surfaces. The instant trim member, by reason of its L-shaped cross-section yields a further benefit, in that it may readily be adapted to provide concealment for housing a blower, with an optional heater element, to act as a source of moving air for preventing or eliminating condensation on the window surface itself, thus eliminating the resulting condensation damage to the plaster or other surfaces contiguous to the window.

Figure 4:
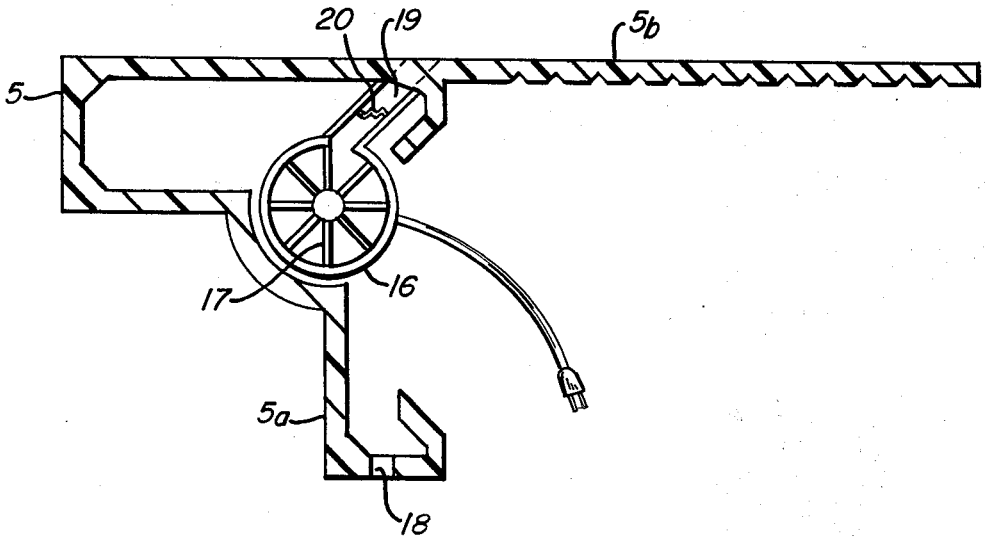
Figure 2:
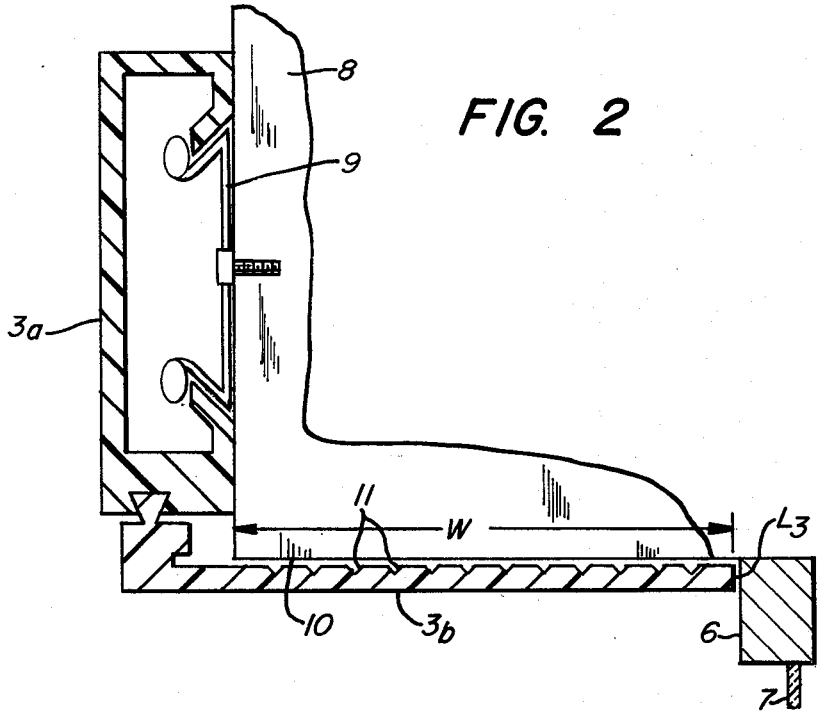
Figure 3:
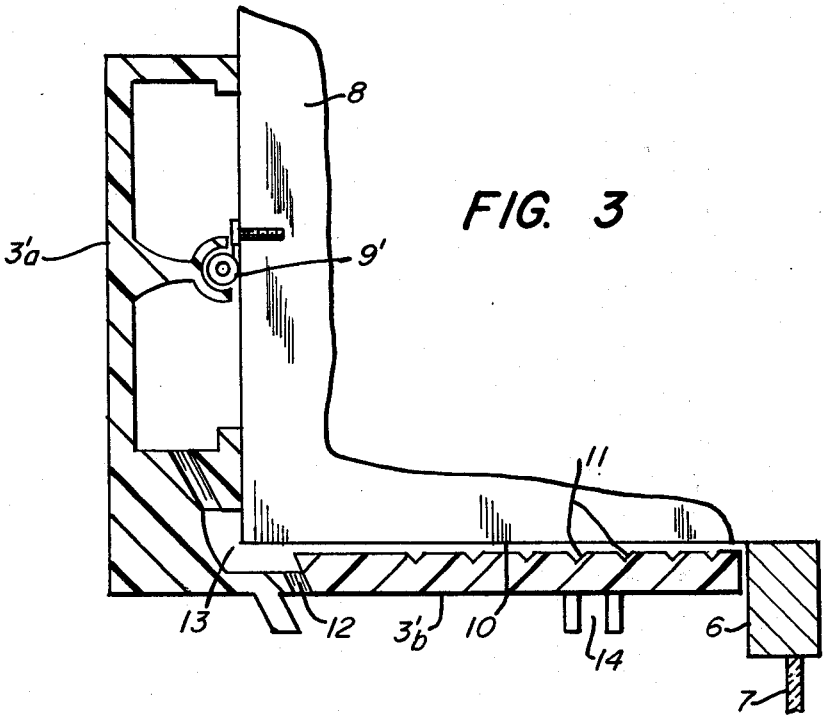

The above and other advantages of the instant invention will become more apparent from the following description, when read in conjunction with the appended claims and the drawings in which:

FIG. 1 is an isometric drawing, illustrative of a complete shell assembly incorporating the instant trim members, FIG. 2 is an enlarged cross-section illustrating certain basic features, including the longitudinal slots, of the instant trim member, FIG. 3 is a cross-section of an alternative trim-member embodiment, incorporating air channels and apertures for directing air against the window surface and FIG. 4 is a cross-section of a sill trim member, which serves to house a blower motor.

Referring to FIG. 1, the shell assembly of the instant invention comprises four trim members for the surrounds of the window opening; a head-trim member 2, left and right side trim members 3 and 4 respectively, and sill-trim member 5. Each trim member is in turn comprised of a casing section (shown in greater detail, in FIGS. 2 through 4 and hereinafter labeled by subscript "a") and a border section (hereinafter labeled with subscript "b") covering the jamb surface of the window. It is one of the significant features of this invention, that the free leading edge L of each such border section will closely approach so as to achieve a proper fit with the corresponding frame surface 6 of window 7. This "proper fit" may readily be achieved as a result of the provision of longitudinal grooves, better illustrated in FIG. 2. This figure shows an enlarged cross-section of side trim member 3. It should be understood, however, that the features described therein are equally applicable to the head and sill trim members. In the embodiment here illustrated, trim member 3 is furnished as discrete elements consisting of casing section $\mathbf{3}_a$ and the border section $\mathbf{3}_b$. By way of example, casing section $\mathbf{3}_a$ is shown affixed to the wall 8 by engagement with metal clip 9. Border section $\mathbf{3}_b$, on the other hand, is shown affixed to jamb surface 10 without using clips, e.g. by adhesive bonding. It should be understood, therefore, that such means for affixing the instant trim member to the wall surfaces are illustrative only and any well known means such as nailing, glueing, double-face tape, and clip devices may be employed. Border section $\mathbf{3}_b$, whether furnished as a discrete element, as illustrated in FIG. 2, or integral with the casing section as shown in FIG. 3, is provided with longitudinal, parallel slots or grooves 11, traversing at least a major portion of the width w, thereof. Such grooves are formed to run the entire length of element $\mathbf{3}_b$ and to be parallel to the free longitudinal edge $L_3$ of section $\mathbf{3}_b$. The provision of such grooves, preferably spaced from each other a distance of $\frac{1}{2}$ to $\frac{1}{8}$ inch or even smaller, permits the width of section $\mathbf{3}_b$ readily to be modified to achieve a "proper fit" to frame surface 6. For example, the jamb surface widths of most window openings generally fall within the range of about $\frac{1}{2}$ to 6 inches. Therefore, trim members could be stocked with border sections having, say, widths of 6 inches, 4 inches and 2 inches. Thus, for a window having a jamb surface width of 5 inches, a border section having a width of 6 inches would be ordered, and thereafter would be trimmed, cut or broken off at the groove closest to that 5-inch width, so as to provide a proper fit against surface 6. Similarly, for a window having a jamb surface width of $1\frac{1}{2}$ inches, a trim member having a border section width of 2 inches would desirably be ordered. Of course, in the event that a supplier were only to stock trim members having one size of border section, e.g., with a 6-inch width, such a wide section trim member nevertheless could be trimmed down to 1½ inches; although such a procedure would be somewhat wasteful of materials. The various trim members for a particular window opening will, of course, be ordered to match each other, e.g. in color, style, width of casing section, etc. The casing sections of the trim members may be furnished, to form the completed shell, either by butt-joining or miter-joining. The border sections, on the other hand, will invariably be butt-joined.

FIG. 3 is another embodiment of the trim member, illustrating additional features which may be incorporated therein. As may be seen from this figure, trim member 3' as prefabricated at the factory, is furnished as one integral piece, incorporating sections $3'_a$ and $3'_b$. An alternative method for affixing the casing section $3'_a$ to wall 8 is shown for purposes of illustration only, since no specific method of attachment is critical to the instant invention. A significant feature illustrated here, is the provision of outlet aperture 12 (the face of which may be variously shaped, e.g. in the form of a rectangular slot, oval or circle), which is inclined toward the window surface 7, thereby forming an acute angle with the plane of the border section. The aperture (or preferably apertures) are, in turn, connected to a duct 13 which channels air from a pressure source such as a blower (not shown). An additional feature herein illustrated, is the incorporation of a sash element 14 for mounting supplemental panels, e.g. screens or, more particularly, storm windows. The interior mounting of such storm windows provides an additional benefit to the homeowner, in ease of removal and insertion, as compared with the more conventionally employed exterior panels. Finally, by reason of the flange construction, the width of the jamb surface, along the length thereof, need not be uniform in order to achieve a professional looking fit. Thus, variation in such width will readily be compensated and concealed within the interior corner of the L-shaped cross-section.

FIG. 4 is a cross-section of sill-trim member 5 illustrating how such members may be designed as an enclosure or concealment for housing a blower motor. In utilizing this feature of the invention, it is preferably that the blower be incorporated in the sill member, since the latter can generally be designed with a greater cross-sectional area to achieve such concealment and nevertheless maintain its aesthetic qualities. However, it should be understood that it is within the purview of this invention that the blower may nevertheless be incorporated in one or both side-trim members or in the head-trim member. Referring to FIG. 4, integral sill trim member 5 serves as a decorative enclosure for blower 16, the latter preferably being hidden from view so as not to mar the appearance of the window area. In operation, fan 17 driven by a motor (not shown, but similarly enclosed within inlet member 5) draws air through inlet apertures 18 and exhausts air through outlet channel 19. Heating element 20 may optionally be inserted in channel 19 for heating and drying the discharged air, which subsequently will be directed across the surface of the window. Channel 19, in turn, is connected to ducts 13 (see FIG. 3) to exhaust the air, whether or not heated, through apertures 12 against the window surface; the exhausted air preferably fanning out so as to cover the entire window area. In a preferred embodiment, such coverage will be achieved by directing the air from one side trim member, e.g. the left side border section, to fan-out and impinge upon the corresponding left half window surface. In conjunction therewith, air from the right side border section will similarly be directed to fan-out and impinge upon the corresponding right half window surface, whereby the two air patterns emerging from the left and right sides respectively, will provide a degree of turbulence, enhancing the evaporation of any condensation on the glass surface and preventing the formation of new condensation.

It will readily be apparent that the trim members of this invention may be constructed from a variety of materials, such as metal or wood. However, the design thereof is most amenable to fabrication from plastic, either by molding or extrusion. In addition to ease of fabrication, plastic can be produced in various shapes and colors so as to complement the decorative scheme of any room in which such trim members are to be employed. The prefabricated construction of the instant trim member, when employed in conjunction with any of the detachable clips well known to the art, may readily be replaced, with a member having a different color or design, in the event that the decor of the room is altered.

I claim:

1. A shell assembly comprised of trim members for the interior surrounds of a substantially rectangular window opening, said trim members being joined together so as to form the trim facing for said window; each such trim member being comprised of (i) an elongated casing section having an interior surface adapted for attachment to the wall surrounding said window opening, the inner longitudinal edge of said casing section being joined with and substantially perpendicular to (ii) an elongated border section, having a length commensurate with the length of said casing section and a width of from about ½ to 6 inches, the interior surface of said border section being adapted for attachment to the jamb surface which is perpendicular to the plane of the wall and to the plane of the window, a major portion of said interior surface having longitudinal grooves therein, said grooves being parallel to each other and to the free longitudinal edge of said border section, and being spaced from each other a distance of about ⅛ to ½ inch, permitting said width readily to be modified to correspond with the depth between the wall and the window rail, so as to fit properly therebetween when said trim member is attached to the wall, wherein the border section of at least one of said side trim members has an interior surface constructed to provide at least one approximately longitudinal channel between said interior surface and said jamb surface, in which a portion of said channel near one end thereof can be connected to a source of air under a pressure greater than ambient, while another portion near the other end thereof connects to an aperture penetrating the thickness of said border section at an acute angle thereto, whereby air flowing through said channel and said aperture will be caused to flow over the inner surface of the window and prevent condensation thereon.

2. The shell assembly of claim 1, wherein said trim members are constructed from plastic material, and said casing section is integral with said border section.

3. The shell assembly of claim 1, wherein said channel is formed from said parallel grooves.

4. The shell assembly of claim 1, including a sill trim member which forms an enclosure for housing internally therein, a blower to provide said source of air under pressure.

5. The shell assembly of claim 1, wherein the border section of both side trim members has an interior surface constructed to provide said longitudinal channel between said interior surface and said jamb surface.

* * * * *